US005906242A

United States Patent [19]

Bruewer et al.

[11] Patent Number: 5,906,242

[45] Date of Patent: May 25, 1999

[54] METHOD OF SUSPENDING AND ESP WITHIN A WELLBORE

[75] Inventors: Timothy B. Bruewer; Grant T. Harris, both of Lawrence, Kans.

[73] Assignee: Camco International, Inc., Houston, Tex.

[21] Appl. No.: 08/867,018

[22] Filed: Jun. 3, 1997

[51] Int. Cl.[6] ..... E21B 43/00

[52] U.S. Cl. ..... 166/378; 166/68

[58] Field of Search ..... 166/68, 68.5, 105, 166/107, 117.5, 249, 65.1

[56] References Cited

U.S. PATENT DOCUMENTS

| | | | |
|---|---|---|---|
| 1,750,111 | 3/1930 | Mahlke . | |
| 1,912,794 | 6/1933 | Peterson . | |
| 3,650,324 | 3/1972 | Randles et al. | 166/68.5 |
| 3,835,929 | 9/1974 | Suman, Jr. . | |
| 4,009,756 | 3/1977 | Zehren | 166/68 X |
| 4,262,226 | 4/1981 | Erickson | 310/87 |
| 4,336,415 | 6/1982 | Walling . | |
| 4,346,256 | 8/1982 | Hubbard et al. . | |
| 4,616,955 | 10/1986 | Wallace et al. | 405/158 |
| 4,681,169 | 7/1987 | Brookbank, III . | |
| 4,830,113 | 5/1989 | Geyer . | |
| 4,928,771 | 5/1990 | Vandevier | 166/68 X |
| 5,145,007 | 9/1992 | Dinkins . | |
| 5,146,982 | 9/1992 | Dinkins . | |
| 5,180,014 | 1/1993 | Cox | 166/68 X |
| 5,191,173 | 3/1993 | Sizer et al. . | |
| 5,193,614 | 3/1993 | Cox . | |
| 5,211,225 | 5/1993 | Grosch | 166/107 X |
| 5,269,377 | 12/1993 | Martin . | |
| 5,293,931 | 3/1994 | Nichols et al. | 166/68 X |
| 5,435,351 | 7/1995 | Head . | |

FOREIGN PATENT DOCUMENTS

| | | |
|---|---|---|
| 2318167 | 4/1998 | United Kingdom . |

*Primary Examiner*—Frank S. Tsay

[57] ABSTRACT

A method of suspending an electric submergible pumping system within a wellbore includes inserting an electric cable within a conduit, such as coiled tubing. One end of the conduit is sealed with one end of the electric cable extending out therefrom. The conduit is filled with a fluid of sufficient volume and sufficient density to float the electric cable within the conduit when the conduit is disposed within a wellbore. An electric submergible pumping system is connected to the conduit, and the electric cable is connected to an electric motor of the electric submergible pumping system. Thereafter, the electric submergible pumping system and the conduit are inserted into the wellbore. Since the cable is floating, i.e., self supporting, within the conduit there is no need for cable anchors or other devices to transfer the weight of the cable to the conduit.

23 Claims, 2 Drawing Sheets

METHOD OF SUSPENDING AND ESP WITHIN A WELLBORE

BACKGROUND OF THE INVENTION

1. Field of the Invention

The present invention relates to methods and related components for suspending an electric submergible pumping system ("ESP") within a wellbore and, more particularly, to methods and related components for disposing an electric power cable within a conduit in a manner that does not require devices to transfer the weight of the cable to the conduit.

2. Description of Related Art

To reduce the size of equipment and the associated costs needed to deploy and recover an electric submergible pumping system ("ESP") within a wellbore, ESP's can be suspended from coiled tubing, rather than conventional jointed tubing. This method takes advantage of the relatively low cost and ease of transportation of the units used to install and remove coiled tubing. Typical arrangements for suspending an ESP on coiled tubing are disclosed in U.S. Pat. Nos. 3,835,929; 4,830,113; and 5,180,014.

The electric power cable that is used to connect an electric motor of the ESP to a surface power source does not have sufficient internal strength to support its own weight over about 60 feet. Therefore, the cable is clamped, banded or strapped to the outside of the jointed tubing or the coiled tubing at intervals, as disclosed in U.S. Pat. No. 4,681,169. Alternatively, the cable can be disposed within the coiled tubing, as disclosed in U.S. Pat. Nos. 4,336,415; 4,346,256; 5,145,007; 5,146,982; and 5,191,173.

When the cable is disposed within the coiled tubing, standoff devices are often used to centralize the cable within the coiled tubing to permit fluid production through the coiled tubing. These prior standoff devices also support the cable, in place of the prior external clamps or straps, by preventing longitudinal movement of the cable with respect to the coiled tubing and thereby transfer the weight of the cable to the coiled tubing. These standoff devices are usually referred to as cable anchors, and examples thereof are disclosed in U.S. Pat. Nos. 5,193,614; 5,269,377; and 5,435,351.

Common problems associated with cable anchors are as follows. The cable and the coiled tubing have very different coefficients of thermal expansion, so that when the cable thermally expands after exposure to well conditions it is rigidly held by the cable anchors, and as such stress-related failures occur within the cable. Some prior cable anchors are relatively mechanically complex, and require injection of a solvent to release and set the anchors. Some cable anchors require a time consuming and uncontrollable chemical interaction to cause elastomeric materials on the cable or in the cable anchors to swell, and thereby frictionally engage the interior of the coiled tubing. Also, cable anchors tend to slip over time, so the cable extends longitudinally, which can damage or break the copper conductors. In addition, the cable will be compressed against the lowermost electrical connector. This cable compression has caused electrical connectors to fail, necessitating the costly removal of the ESP from the well. Compounding the problem, the cable anchors often are very difficult to release to permit the removal of the cable from the coiled tubing.

There is a need for a simple method and related components for quickly and predictably disposing an electrical power cable within a conduit, such as coiled tubing, that does not need cable anchors or other devices to transfer the weight of the cable to the conduit.

SUMMARY OF THE INVENTION

The present invention has been contemplated to overcome the foregoing deficiencies and meet the above described needs. Specifically, the present invention comprises methods and related components for disposing an electrical power cable within a conduit. In one preferred method of the present invention, an electric cable is inserted into a conduit, such as coiled tubing, and the conduit is filled with a fluid of sufficient volume and sufficient density to float the electric cable within the conduit. An electric submergible pumping system is connected to the conduit, and the electric cable is connected to an electric motor of the electric submergible pumping system. Thereafter, the electric submergible pumping system and the conduit are inserted into the wellbore. Since the cable is floating, i.e., self supporting, within the conduit, there is no need for cable anchors or other devices to transfer the weight of the cable to the conduit. Thus, the prior problems of cable compression and electrical connector damage are eliminated, and there are no thermal-expansion caused failures of the cable, and the cable can be easily removed from the conduit.

DETAILED DESCRIPTION OF THE PREFERRED EMBODIMENTS

For the purposes of the present discussion, the methods and related components of the present invention will be described for example as relating to suspending an electric submergible pumping system ("ESP") on a conduit within a wellbore. It should be understood, however, that any type of conduit, tube or pipe can be used, such as coiled tubing, jointed tubing and the like, to suspend any type of wellbore equipment, such as logging tools, wireline tools, drilling tools, and the like, within a wellbore. Further, for the purposes of the present discussion, the methods and related components of the present invention will be described for example as relating to "floating" a power cable within a conduit, which is connected to an ESP; however, it should be understood that the methods of the present invention can be used to "float" any type of cable, tube, conduit, cable, wire or rope within any type of conduit.

Figure 1:
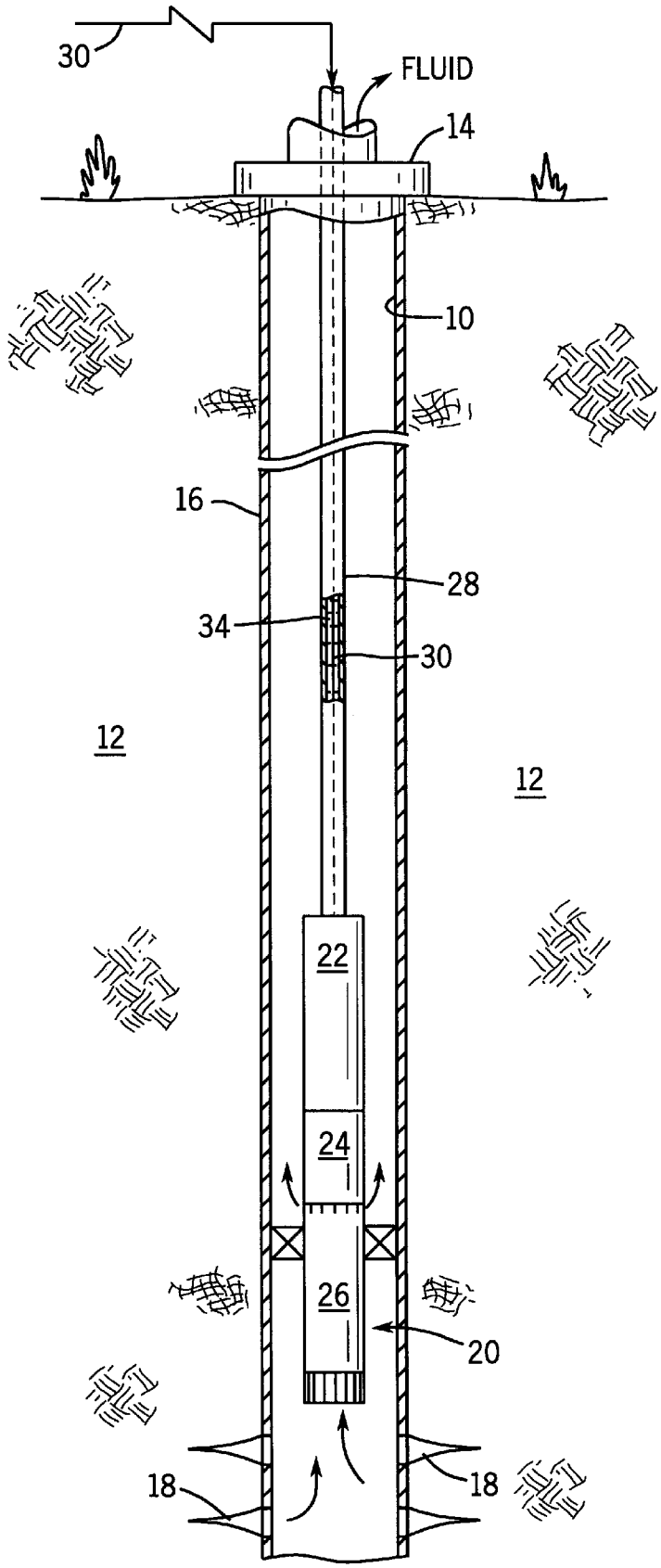
FIG. 1 is a partial cross-sectional view of a subterranean wellbore with an ESP suspended on a conduit therein, in accordance with one preferred method of the present invention.
Figure 2:
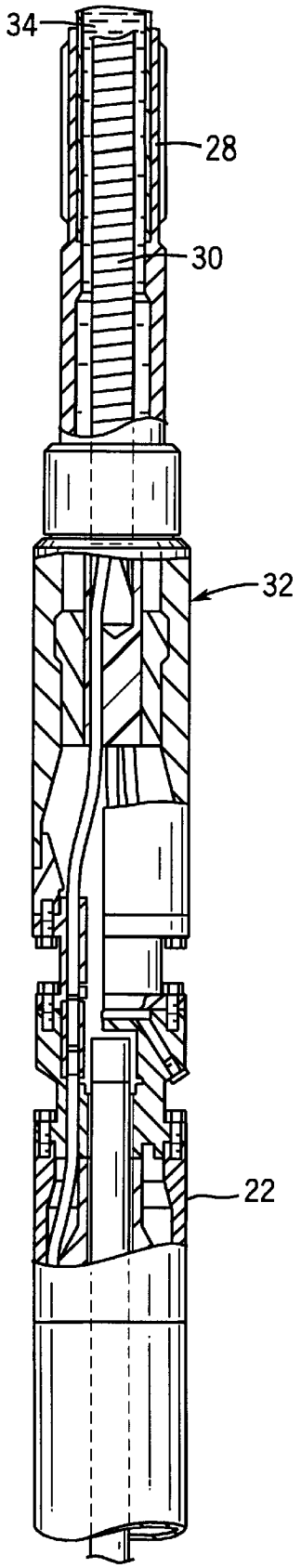
FIG. 2 is a partial cross-sectional view of a conduit connected to an ESP, and with an electric cable floating there within, in accordance with one preferred method of the present invention.

To better understand the present invention, reference will be made to the accompanying drawings. FIG. 1 shows a wellbore 10, used for recovering fluids such as water and/or hydrocarbons, that penetrates one or more subterranean earthen formations 12. The wellbore 10 includes a wellhead 14 removably connected to an upper portion of a production tubing and/or casing string 16, as is well known to those skilled in the art. If the casing string 16 extends across a fluid producing subterranean formation 12, then the casing string 16 can include at least one opening or perforation 18 for permitting fluids to enter the interior thereof. An electric submergible pumping system ("ESP") 20 is shown suspended within the casing string 16, and generally includes an electric motor 22, an oil-filled motor protector 24, and a pump 26. The ESP 20 is shown in FIG. 1 in an upside-down arrangement with the motor 22 above the pump 26; however, it should be understood that the present invention can be used when the ESP 20 is deployed in a conventional configuration with the motor 22 below the pump 26.

For the purposes of this discussion, the terms "upper" and "lower", "above" and "below", "uphole" and "downhole", and "upwardly" and "downwardly" are relative terms to indicate position and direction of movement in easily recognized terms. Usually, these terms are relative to a line drawn from an upmost position at the surface of the earth to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

The ESP 20 is operatively connected to a lower end of a conduit 28, such as a plurality of lengths of jointed tubing, or to a length of coiled tubing that has been spooled into the casing 16, as i5 is well known to those skilled in the art. The conduit 28 can be of any commercially available size (ie. outside/inside diameter) and formed from any material suitable to the wellbore conditions, as all is well known in the art. For example, typical sizes of coiled tubing are from 0.75" OD to 3.5" OD, and are made from aluminum, steel, titanium, and alloys thereof.

One end of an electrical cable 30 is operatively connected to the ESP 20 to provide electrical power to the motor 22, and is operatively connected at an opposite end at the earth's surface to electrical control equipment and a source of electrical power (both not shown), as are both well known in the art. Commercially available electrical cable 30 typically used with ESP's 20 does not have sufficient internal strength to support its own freely suspended weight; therefore, in the past a plurality of cable anchor assemblies were inserted within the coiled tubing. The prior cable anchor assemblies were used to transfer the weight of the cable to the coiled tubing.

As briefly described previously, the present invention does not use cable anchors, but instead relies on the concept of "floating" the cable 30 within its conduit 28. The term "float" means the use of a fluid within the conduit 28 that has a density (i.e., weight per unit volume) that is approximately equal to or greater than the density of the cable 30, so that the cable 30 will be self supporting or be buoyant within the fluid. When the cable 30 is floated, there is no need for cable anchors because the cable 30 is not suspended and cannot be damaged by its own unsupported weight. Further, the cable 30 will not compress and damage the electrical connectors, as when the prior cable anchors slipped. In the event that the cable 30 is to be removed from the coiled tubing, the cable can simply be pulled out, because there are no anchors or other gripping devices to impede the movement of the cable.

In one preferred embodiment of the present invention, the cable 30 is inserted into the conduit 28, such as coiled tubing, by any of the methods as described in the above referenced prior patents. This can take place during the manufacture of the coiled tubing or in the field. One preferred filed method is to unspool the coiled tubing on the ground, run a guide wire therethrough, attach one end of the guide wire to the cable and attach the other end of the guide wire to a vehicle. The cable is coated with a friction-reducing agent, such as grease or oil, and the vehicle is then moved to pull the cable into the coiled tubing.

Once the cable 30 has been inserted into the coiled tubing 28, one end thereof, which will be the lowermost end adjacent the ESP 20, extends out from one end of the coiled tubing 28 and is sealed, such as by a pressure fitted connector and/or cap 32, as is well known to those skilled in the art. The interior of the conduit 28 is filled with a fluid 34, such as drilling mud, of sufficient density to float the electric cable 30 within the conduit 28 when the conduit 28 is disposed within the wellbore 10. The fluid- and cable-filled coiled tubing 28 is then respooled, and transported into position adjacent the wellbore 10.

The ESP 20 is connected to the lower end of the conduit 28, as is well known to those skilled in the art, and the lower end of the electric cable 30 is operatively connected to the motor 22. The ESP 20 is lowered into the wellbore 10, such as by the use of an injector head (not shown), as is well known to those skilled in the art. The upper end of the coiled tubing 28 is sealed by the wellhead 14, as is well known to those skilled in the art, and the upper end of the cable 30 is operatively connected to a power source.

An alternate preferred method of installing the cable 30 within the coiled tubing 28 comprises including one or more tubes within the cable 30, as is well known to those skilled in the art, or attached to the outside thereof. The cable 28 is pulled through the coiled tubing 28 as before, a bottom end of the coiled tubing 28 is sealed, and then the chosen fluid is injected through the tube into the coiled tubing 28. A variation on this method is to pump the chosen fluid into the coiled tubing 28 after the cable 30 is installed therein, and permit air to escape out through a second of the tubes. The use of one or more tubes permits relatively easy removal and addition of the fluid and/or additives to the fluid to change its density.

Another preferred method of installing the cable 30 within the coiled tubing 28 comprises sealing a lower end of the cable 30 within the coiled tubing 28, and then pumping a fluid, such as air or the chosen fluid to float the cable, into the coiled tubing 28 to hydraulically push the cable 30 into and through the coiled tubing 28.

Once the ESP 20 has been properly landed within the wellbore 10, fluid 34 is either added to or removed from the conduit, if necessary, to ensure that the cable 30 is approximately neutrally buoyant within the conduit 28. In addition, the density of the fluid 34 can be changed by the circulating into the conduit 28 additives and/or other fluids of varying densities to create a fluid within the conduit 28 that will "float" the cable 30. If not enough fluid is used or if the density of the fluid is too low, then the cable will sink within the conduit, stretch or damage the conductors, and compress the lower electrical motor connector and/or cap 32. As stated previously, this compression should be avoided to prevent electrical failures of the ESP 20. If too much fluid is used or if the fluid density of the fluid is too high, then the cable 30 will tend to rise within the conduit and stretch the electrical motor connector and compress any surface electrical connectors.

The fluid 34 needs to have a density that is approximately equal to (e.g., may be slightly less than) or greater than the density of the cable 30. It should be understood that the density of the cable 30 may change over time, so the density of the fluid 34 may need to be selected to be slightly under or over the optimum density to float the cable 30 upon its installation. For example, the EPDM or nitrile rubber in the jacket of the cable 30 will absorb oil and thus will swell.

This absorption of oil reduces the density of the cable 30. So, the density of the fluid 34 can be altered to compensate for this absorption of oil at the time of the initial installation of the fluid 34 or during the operation of the ESP 20. Periodically, the tension on the cable 30 can be measured at the earth's surface, as is well known to those skilled in the art, and adjustments can be made in the density of the fluid 34 at that time to ensure that the cable 30 is properly "floating" within the coiled tubing 28.

The fluid 34 preferably will have a specific gravity greater than 1 and up to about 5. This fluid can be a liquid, emulsion, foam or a gel. Preferred fluids include any hydrocarbon-based liquid, such as wellbore fluids, oil, diesel fuel, oil-based drilling mud, or water-based liquid, such as water, brine, sea water, water-based drilling mud. In addition, other materials can be added to the fluid 34 to increase or decrease its density, such as weighting material, barite, bentonite, lost circulation materials, spheres of material, such as float ash, ceramic beads, Styrofoam, and the like.

The inventors hereof have made calculations illustrating two sample installations of floating cable within coiled tubing. In the first example, a commercially available #2 C/S PPEO 5 kV armored cable has a calculated density of about 3.638 grams/cubic centimeters. Using a coiled tubing with a 1.5 inch internal diameter, the fluid needed to float the cable would have a density of approximately 3.60 grams/cubic centimeters or about 30.3 lbs/gallon. This density of fluid is commonly achievable in the drilling industry. If the coiled tubing is 6,000 feet in length, then the resulting pressure of the fluid, measured at the downhole cable connector, is about 9,500 pounds per square inch, which is well within the pressure rating of commercially available coiled tubing and of commercially available cable connectors.

In a second example, a commercially available #2 C/S ETBE 5 kV armored cable with a 0.25 inch diameter injection tube therein has a calculated density of about 4.317 grams/cubic centimeters. Using a coiled tubing with a 2.0 inch internal diameter, the fluid needed to float the cable would have a density of approximately 4.32 grams/cubic centimeters or about 36.0 lbs/gallon. This density of fluid is commonly achievable in the drilling industry. If the coiled tubing is 6,000 feet in length, then the resulting pressure of the fluid, measured at the downhole cable connector, is about 11,500 pounds per square inch, which is well within the pressure rating of commercially available coiled tubing and of commercially available cable connectors.

As can be understood from the previous discussion, the present invention provides a novel method and related components for suspending an ESP within a wellbore using the concept of "floating" the cable to therefore eliminate the need for and the problems with cable anchors or other devices to transfer the weight of the cable to the conduit.

Wherein the present invention has been described in particular relation to the drawings attached hereto, it should be understood that other and further modifications, apart from those from those shown or suggested herein, may be made within the scope and spirit of the present invention.

What is claimed:

1. A system for pumping fluids from a well, comprising:

a length of conduit for suspension within a wellbore;

an electric submergible pumping system including a pump operatively connected to an electric motor, the electric submergible pumping system being suspended by the length of conduit during deployment in the wellbore;

an electric cable disposed within the conduit;

a fluid within the conduit of sufficient volume and sufficient density to float the electric cable within the conduit; and a seal portion disposed about the electric cable to seal the fluid within the conduit.

2. An electric submergible pumping system of claim 1 wherein the density of the fluid is approximately equal to or greater than the density of the electric cable.

3. An electric submergible pumping system of claim 2 wherein the conduit comprises a plurality of lengths of jointed tubing.

4. An electric submergible pumping system of claim 2 wherein the conduit comprises a length of coiled tubing.

5. An electric submergible pumping system of claim 1 wherein the fluid is drilling mud.

6. An electric submergible pumping system of claim 1 wherein the fluid has a specific gravity of between 1 and about 5.

7. A method of installing a pumping system for use in a wellbore, comprising:

inserting an electric cable within a conduit;

filling the conduit with a fluid of sufficient volume and sufficient density to float the electric cable within the conduit when the conduit is disposed within a wellbore;

sealing a first end of the conduit around the electric cable; and connecting an electric submergible pumping system to the first end of the conduit.

8. The method of claim 1 and further comprising deploying the electric submergible pumping system in the wellbore via the conduit.

9. The method of claim 7 and further comprising operatively connecting a first end of the electric cable to an electric motor of the electric submergible pumping system.

10. The method of claim 7 wherein the density of the fluid is approximately equal to or greater than the density of the electric cable.

11. The method of claim 7 wherein the conduit comprises a plurality of lengths of jointed tubing.

12. The method of claim 7 wherein the conduit comprises a length of coiled tubing.

13. The method of claim 7 wherein the fluid is drilling mud.

14. Th method of claim 7 wherein the fluid has a specific gravity of between 1 and about 5.

15. A method of suspending an electric submergible pumping system within a wellbore, comprising:

(a) inserting an electric cable within a conduit;

(b) filling the conduit with a fluid of sufficient volume and sufficient density to float the electric cable within the conduit when the conduit is disposed within a wellbore;

(c) connecting an electric submergible pumping system to the one end of the conduit;

(d) operatively connecting the one end of the electric cable to an electric motor of the electric submergible pumping system; and (e) inserting the electric submergible pumping system and the conduit into the wellbore.

16. A system for pumping fluids from a wellbore to the earth's surface, comprising:

a submergible pumping system including an electric motor and a pump;

a coiled tubing connected to the submergible pumping system to deploy it in the wellbore;

an electric cable connected between the electric motor and the earth's surface, the electric cable being disposed through a hollow interior of the coiled tubing; and a fluid disposed in the hollow interior, wherein the fluid has sufficient density to substantially float the electric cable.

17. The system as recited in claim 16, wherein the fluid has a density greater than approximately 2 grams per cubic centimeter.

18. The system as recited in claim 16, further comprising a seal member disposed between the coil tubing and the electric cable to seal the fluid within the coiled tubing above the electric motor.

19. The system as recited in claim 16, wherein the fluid within the coiled tubing is static.

20. A system for pumping fluids from a wellbore to a surface of a planet, comprising:

a submergible system for use in a wellbore;

a conduit having a hollow interior, the conduit having a first end attached to the submergible system, the conduit having sufficient strength to support the submergible system during deployment in the wellbore;

a fluid filling the hollow interior; and a free-floating power cable disposed in the hollow interior, wherein the fluid provides sufficient buoyancy to substantially support the weight of the free-floating power cable.

21. The system as recited in claim 20, wherein the conduit comprises coiled tubing.

22. The system as recited in claim 21, wherein the submergible system comprises an electric submergible pumping system having an electric motor and a submergible pump.

23. The system as recited in claim 21, wherein the fluid has a density greater than approximately 2 grams per cubic centimeter.

* * * * *